US005872517A

United States Patent [19]

Mochizuki et al.

[11] Patent Number: 5,872,517

[45] Date of Patent: Feb. 16, 1999

[54] FIRE DETECTOR

[75] Inventors: Mikio Mochizuki; Eiji Hirooka; Makoto Yasukawa, all of Tokyo, Japan

[73] Assignee: Nohmi Bosai Ltd., Tokyo, Japan

[21] Appl. No.: 862,405

[22] Filed: May 23, 1997

Related U.S. Application Data

[62] Division of Ser. No. 63,422, May 19, 1993, Pat. No. 5,670, 948.

[30] Foreign Application Priority Data

May 25, 1992 [JP] Japan ..... 4-132875
May 25, 1992 [JP] Japan ..... 4-132876

[51] Int. Cl.[6] ..... G08B 17/10

[52] U.S. Cl. ..... 340/630; 340/628; 250/574

[58] Field of Search ..... 340/630, 629, 340/628, 527, 501; 250/573, 574

[56] References Cited

U.S. PATENT DOCUMENTS

| | | | |
|---|---|---|---|
| 3,634,839 | 1/1972 | Vassil . | |
| 3,659,278 | 4/1972 | Jensen | 340/630 |
| 3,710,365 | 1/1973 | Barnes . | |
| 3,866,195 | 2/1975 | Ried, Jr. . | |
| 4,081,795 | 3/1978 | Ogawa . | |
| 4,097,850 | 6/1978 | Conforti . | |
| 4,193,069 | 3/1980 | Cooper et al. . | |
| 4,198,627 | 4/1980 | Kakigi . | |
| 4,203,100 | 5/1980 | Yamauchi et al. . | |
| 4,300,133 | 11/1981 | Solomon . | |
| 4,317,113 | 2/1982 | Honma . | |
| 4,319,229 | 3/1982 | Kirkor | 340/577 |
| 4,420,746 | 12/1983 | Malinowski | 340/630 |
| 4,524,351 | 6/1985 | Kimura et al. . | |
| 4,654,644 | 3/1987 | Dobrzanski . | |
| 4,910,501 | 3/1990 | Montoya | 340/630 |
| 5,497,009 | 3/1996 | Torikoshi et al. | 340/630 |

FOREIGN PATENT DOCUMENTS 58-162843 9/1983 Japan .

*Primary Examiner*—Edward Lefkowitz
*Attorney, Agent, or Firm*—Wenderoth, Lind & Ponack, L.L.P.

[57] ABSTRACT

A fire detector capable of readily and accurately adjusting the sensitivity thereof and of not erroneously outputting any fire signal is provided with a first-stage amplifying circuit having an output adjusting variable resistor and a fire discriminating section having a reference voltage adjusting variable resistor. As a result, it is possible to adjust the amplified output to a predetermined value by the switching level of the fire discriminating section to a predetermined value by the reference voltage adjusting variable resistor.

11 Claims, 5 Drawing Sheets

FIRE DETECTOR

This is a divisional application of Ser. No. 08/063,422, filed May 19, 1993 now U.S. Pat. No. 5,670,948.

BACKGROUND OF THE INVENTION

1. Field of the Invention

The present invention relates to a fire detector, and more particularly to a photoelectric type fire detector capable of photoelectrically detecting smoke generated as a result of a fire, as well as to a heat-photoelectric type fire detector which detects occurrence of fire by sensing both heat and smoke generated by the fire.

2. Description of the Related Art

In the conventional photoelectric smoke detector, when smoke arises due to fire, the light emitted from a smoke detecting light-emitting element of a light-emitting section is scattered by the smoke and enters a smoke detecting light-receiving element of a light-receiving section. The scattered light received by the light-receiving element is then amplified in an amplifying circuit and then sent to a fire discriminating section where fire discrimination is made on the basis of the output value. If it is determined that there is fire, the discriminating section transmits a fire signal to a fire signal transmitting section through an accumulating circuit, and the transmitting section sends this fire signal to a fire receiver etc. for reporting the fire.

In the conventional photoelectric type smoke detector, the sensitivity of the detector is adjusted by a sensitivity adjusting means and the operation of the fire discriminating section etc. is stabilized by means of a constant voltage circuit. Further, in such a type of detector, a pulse output of an oscillating circuit is supplied to an operation indicating lamp so that the lamp is intermittently turned on to indicate that the detector is normally operating.

In the conventional sensitivity adjustment, a reflecting plate, which would generate a scattering light being equivalent to the scattering light which would be generated when 10%/m of smoke has entered, is disposed in a smoke detecting dark box of the photoelectric type smoke detector, and a detected output at that time is used for selecting a reference resistance of a comparator as a fire discriminating means such that the comparator replies. As a result, the detected output would become varied due to the dispersion of the circuit constant of an electric circuit of the respective photoelectric smoke detector. This leads to troublesome procedure for the sensitivity adjustment i.e. the selection of the reference resistance. In addition, since a different value of the detected output is obtained in each of the photoelectric type smoke detectors, in order to know the historical variation of the sensitivity of the detector from the initial state, the initial detected outputs of the detectors must be recognized, which has been laborious procedures.

The conventional detector includes an accumulating circuit composed of a plurality of D-type flip-flops. Accordingly, for example, the fire signal would be sometimes undesirably transmitted from the fire signal transmitting section by the operation of the accumulating circuit upon turning on of the power source when the fire resetting operation is carried out.

The constant voltage circuit in the conventional detector is composed of a transistor, a Zener diode connected to a base of the transistor, and a resistor connected between a collector and the base of the transistor. Therefore, when there is a significant difference in the power source voltage to be supplied to the smoke detector between the fire receivers, the current to be consumed in the constant voltage circuit of the smoke detector varies depending on the fire receiver connected there to. For example, when the power source voltage is high, the current flowing through the Zener diode of the constant voltage circuit becomes correspondingly large, while when the power source voltage is low, the current flowing through the Zener diode of the constant voltage becomes correspondingly small.

Thus, in the case of a fire receiver with a high power source voltage to be supplied to the smoke detector, there is a disadvantage in that the number of smoke detectors which can be connected is significantly restricted due to the power consumption of the constant voltage circuit, in comparison with a fire receiver with a low power source voltage. Further, the power source voltage of the fire receiver is sometimes unstable and fluctuates. In such a case, if the fire detector is changed to a smoke detector having semiconductor circuits, a necessary number of fire detectors cannot be connected.

In the conventional detector, the oscillating circuit of the operation indicating lamp is provided separate from and independent of a pulse oscillating circuit for supplying the pulse output to the smoke detecting light-emitting element of the light-emitting section. As a result, even if the pulse oscillating circuit for detecting the smoke fails so as not to make the light-emitting element emit light i.e. in a fire monitoring disabled state, the indicating lamp flickers if the oscillating circuit is normally operable, erroneously indicating that the detector is in normal state.

SUMMARY OF THE INVENTION

It is therefore an object of this invention to provide a fire detector which is capable of readily and accurately adjusting the sensitivity and of not erroneously outputting any fire signal.

It is another object of this invention to provide a fire detector which is capable of keeping the current consumption of a constant voltage circuit unchanged and of accurately indicating the operation.

A photoelectric type fire detector according to a first aspect of the present invention comprises: a light-emitting section for emitting pulsed light for detecting smoke; a light-receiving section, having a first variable resistor for adjusting an output, for receiving scattered light of the light emitted from the light-emitting section caused by smoke; a fire discriminating section, having a second variable resistor for adjusting a reference voltage, for providing a fire discriminating output when the light-receiving output of the light-receiving section reaches the reference voltage; and a fire signal transmitting section for transmitting a fire signal on the basis of the fire discriminating output from the fire discriminating section.

A photoelectric type fire detector according to the second aspect of the present invention comprises: a light-emitting section for emitting pulsed light for detecting smoke; a light-receiving section for receiving scattered light of the light emitted from the light-emitting section caused by smoke; a fire discriminating section for providing a fire discriminating output when the light-receiving output from the light-receiving section reaches a reference voltage; an accumulating circuit for discriminating if any fire discriminating output has been output from the fire discriminating section in synchronism with the pulse light from the light-emitting section, and for outputting a detecting output when discriminating that the fire discriminating outputs have been output for a predetermined number of times successively;

and a fire signal transmitting section for transmitting a fire signal in response to the detected output from the accumulating circuit.

A photoelectric type fire detector according to a third aspect of the present invention comprises: a light-emitting section for emitting pulsed light for detecting smoke; a light-receiving section for receiving scattered light of the light emitted from the light-emitting section and amplifying the light-receiving output, and having a first variable resistor for adjusting the gain of the light-receiving output; an A/D converting circuit for converting the light-received output from the light-receiving section into digital signals; and a signal transmitting section for transmitting the digital signals which have been converted in the A/D converting circuit.

A heat-photoelectric type fire detector according to a fourth aspect of the present invention comprises: a light-emitting section for emitting pulsed light for detecting smoke; a light-receiving section, having a first variable resistor for adjusting the output, for receiving scattered light of the light emitted from the light-emitting section due to the smoke; a smoke fire discriminating section, having a second variable resistor for adjusting a reference voltage, for providing a smoke fire discriminating output when the light-receiving output from said light-receiving section reaches a reference voltage; a heat-sensitive element for detecting heat; a heat fire discriminating section for providing a heat fire discriminating output when the detected output from the heat-sensitive element reaches a predetermined level; and a fire signal transmitting section for transmitting a fire signal when a smoke fire discriminating output or a heat fire discriminating output is provided from at least one of said smoke fire discriminating section and said heat fire discriminating section.

A heat-photoelectric type fire detector according to a fifth aspect of the present invention comprises: a light-emitting section for emitting pulsed light for detecting smoke; a light-receiving section for receiving scattered light of the light emitted from said light-emitting section caused by the smoke; a smoke fire discriminating section for providing a smoke fire discriminating output when the light-received output from the light-receiving section reaches a reference voltage; a heat-sensitive element for detecting heat; a heat fire discriminating section for providing a heat fire discriminating output when the detected output from the heat-sensitive element reaches a predetermined level; a fire signal transmitting section for transmitting a fire signal when a smoke fire discriminating output or a heat fire discriminating output has been output from at least one of the smoke fire discriminating section and the heat fire discriminating section; and a constant voltage circuit for converting an externally introduced power source voltage into a predetermined voltage, and for supplying it to the light-emitting section, the light-receiving section, the smoke fire discriminating section and the heat fire discriminating section; wherein the constant voltage circuit including: a first transistor having an emitter coupled to the light-emitting section, the light-receiving section, the smoke fire discriminating section and the heat fire discriminating section; a first Zener diode having an end connected to a base of the first transistor; and a constant current circuit connected between a collector and the base of the first transistor.

A heat-photoelectric type fire detector according to sixth aspect of the present invention comprises: a light-emitting section for emitting pulsed light for detecting smoke; a light-receiving section, having a first variable resistor for adjusting an output, for receiving scattered light of the light emitted from the light-emitting section caused by the smoke; a heat detecting section for detecting heat by a heat-sensitive element; an A/D converting circuit for converting the light-receiving output of the light-receiving section and the detected output of the heat detection section into digital signals; and a signal transmitting section for transmitting digital signals which have been converted in the A/D converting circuit.

DETAILED DESCRIPTION OF THE PREFERRED EMBODIMENTS

Embodiments of the present invention will now be described with reference to the accompanying drawings.

First Embodiment

Figure 1:
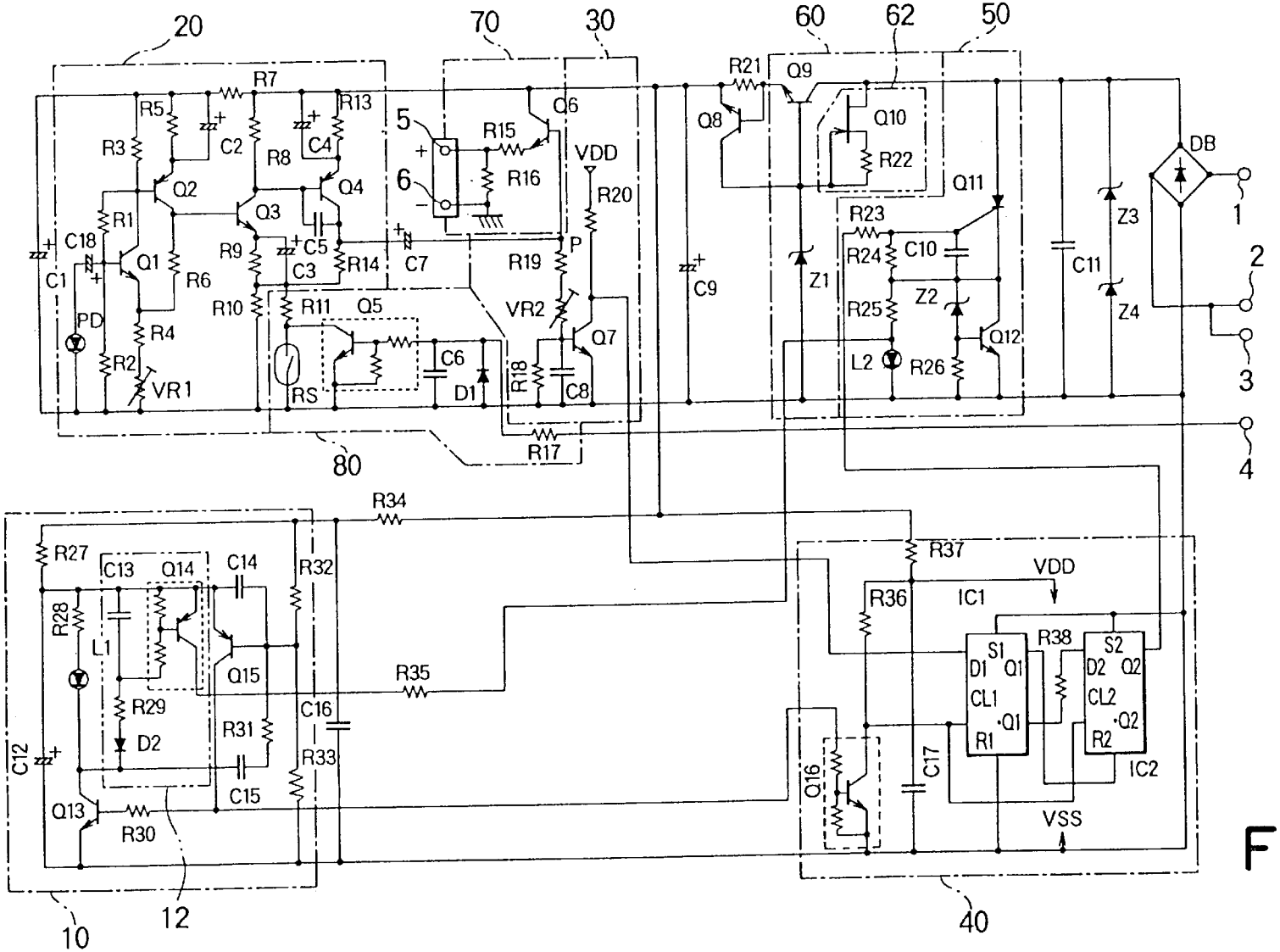
FIG. 1 is a circuit diagram showing a photoelectric type fire detector according to a first embodiment of the present invention.

In FIG. 1, a photoelectric fire detector according to a first embodiment comprises a light-emitting section 10, a light-receiving section 20, a fire discriminating section 30, an accumulating section 40, a fire signal transmitting section 50, a constant voltage circuit 60, a sensor output circuit 70 and a test circuit 80.

The light-emitting section 10 includes a smoke detecting light-emitting element (a light-emitting diode) L1, transistors Q13–Q15, resistors R27–R33, capacitors C12–C15, and a diode D2. In this light-emitting section 10, the transistors Q13 and Q15, the resistors R27, R28, and R30–33, and the capacitors C12, C14, and C15 form an oscillating circuit for supplying a pulse output to the light-emitting element L1.

The transistor Q14, the resistance R29, the capacitor C13 and the diode D2 form a pulse width expanding circuit 12. This pulse width expanding circuit 12 expands the pulse width of the pulse output of the oscillating circuit and supplies it to an operation indicating lamp L2 of the fire signal transmitting section 50.

The light-receiving section 20 includes a smoke detecting light-receiving element (a photo-diode) PD, transistors Q1–Q4, resistors R1–R10, R13, and R14, an output-adjusting variable resistor VR1 and capacitors C2–C5, and C18. The light-receiving element PD does not directly receive the light emitted from the light-emitting element L1, but receives the light scattered by smoke.

The transistors Q1 and Q2, the resistors R1–R6, the output-adjusting variable resistor VR1, and the capacitors C2 and C18 form a first-stage amplifying circuit. This amplifying circuit amplifies the output of the light-receiving element PD, while the variable resistor VR1 is a first sensitivity-adjusting variable resistor used as a feedback resistor for the amplifying circuit.

The transistors Q3 and Q4, the resistors R8–R10, R13, and R14, and the capacitors C3–C5 form a second stage amplifying circuit. This amplifying circuit further amplifies the output of the first-stage amplifying circuit.

The fire discriminating section 30 includes a transistor Q7, resistors R18–R20, a reference voltage adjusting variable resistor VR2 and a capacitor C8. The variable resistor VR2, the second fixed resistor R18 and the first fixed resistor R19 form a divisional resistance circuit (series resistance circuit).

The variable resistor VR2 is a second sensitivity adjusting variable resistor to which the amplified output from the light-receiving section 20 is supplied. The transistor Q7 has a base and an emitter connected to both ends of the second fixed resistor R18 and is a fire discriminating transistor, being turned on and off by a divisional voltage of the divisional resistance circuit.

The accumulating circuit 40 includes a transistor Q16, a resistor R36, a current limiting resistor R37, a resistor R38, a capacitor C17 and D-type flip-flops IC1 and IC2. An output from the transistor Q7 of the fire discriminating section 30 and an output from the oscillating circuit of the light-emitting section are connected to the accumulating circuit 40.

The accumulating circuit 40 discriminates, in synchronism with the pulse output from the oscillating circuit of the light-emitting section 10, whether the transistor Q7 of the fire discriminating section 30 has been turned on a plural number of times, and outputs a detected output if the discriminated result is affirmative. The + and – power source terminals of the flip-flop IC1 and IC2 are connected to VDD and VSS respectively.

The fire signal transmitting section 50 includes a silicon control rectifying element Q11, a transistor Q12, an operation indicating lamp L2, a Zener diode Z2, resistors R23–R26 and a capacitor C10. The rectifying element Q11 is turned on by the detected output of the accumulating circuit 40, and is connected in series with the operation indicating lamp L2.

The transistor Q12 turns on when the circuit comprising the Zener diode Z2 and the resistor 26 has detected a rise of the voltage applied to the operation indicating lamp L2 to a predetermined value so as to prevent a voltage exceeding the predetermined voltage from being applied to the operation indicating lamp L2.

The constant voltage circuit 60 includes a transistor Q9, a junction-type field effect transistor (FET) Q10, a resistor R22 and a Zener diode Z1. The constant voltage circuit 60 supplies a power to the light-emitting section 10, the light-receiving section 20, the fire discriminating section 30 and the accumulating circuit 40.

The transistor Q9 has a constant current circuit 62 between its collector and base, while the Zener diode Z1 is connected between the base of the transistor Q9 and a ground terminal. The constant current circuit 62 is composed of a junction type FET Q10 having a drain connected to the collector of the transistor Q9 and a gate connected to the base of the transistor Q9, and a resistor R22 connected between the source and the gate of the transistor Q10.

The sensor output circuit 70 includes a transistor Q6 and resistors R15 and R16. The base of the transistor Q6 is connected to the connecting point P of the output end of the light-receiving section 20 and the divisional resistance circuit of the fire discriminating section 30, and the emitter thereof is grounded through the output resistors R15 and R16.

The test circuit 80 includes a transistor Q5 used as a switching element, a capacitor C6, resistors R11 and R17, a diode D1 and a reed switch RS closing in response to an approach of a magnet. The switching element Q5 is connected in parallel with a reed switch RS. The parallel circuit of the reed switch RS and the switching element Q5 is arranged in parallel with the gain controlling resistor R10 of the second-stage amplifying circuit of the light-receiving section 20.

A non-polarizing diode bridge circuit DB is provided. The Zener diodes Z3 and Z4 and the capacitor C11 form an absorbing circuit for a surge voltage. The terminals 1, 2 and 3 are for coupling a pair of power-source/signal lines not shown, and the terminal 2 and 3 are short-circuited to connect selectively one power-source/signal line in the detector.

The terminal 4 is an input terminal of the test signal (test voltage), while the terminals 5 and 6 are for outputting an analog light-receiving output of the light-receiving section 20.

The operation of the detector according to this embodiment will now be described. For example, when a power source is turned on to supply power to the detector after restoration from fire, the capacitor C17 for supplying operational power to the flip-flop IC1 and IC2 in the accumulating circuit 40 is charged through the current limiting resistor R37 with a time constant of $\tau$=R37×C17, and the voltage across the capacitor C17 is applied to the flip-flops IC1 and IC2.

At the time of turning on of the power source, the flip-flops IC1 and IC2 are unstable and provide two kinds of states: one, an L output is generated from the output end Q2 of the flip-flop IC2, i.e. no output signal; and the other, an H output is generated from the output end Q2 of the flip-flop IC2, i.e. and output signal present.

When the output end Q2 of the flip-flop IC2 is an L output, the capacitor C17 is directly charged to a predetermined voltage. On the other hand, when the output end Q2 of the flip-flop IC2 is an H output, an H output with a current value limited by the current limiting resistor R37 is generated from the output end Q2. Therefore, since the current necessary to turn on the silicon control rectifying element Q11 is not supplied to its gate through the flip-flop IC2, this element Q11 is not activated. At this time, the capacitor C17 is charged up to a voltage determined by the current limiting resistors R37 and the resistors R23, R24 and R25.

The capacitor C12 of the light-emitting section 10 is charged, via the resistor R27, with a power supplied from a fire receiver (not shown) or a transmitter through the terminals 1 and 2 or 3. When the charging voltage reaches a summed voltage of the divisional voltage by the resistors R32 and R33 and the base-emitter voltage $V_{BE}$ of the transistor Q15 (hereinafter referred to as a light-emitting reference voltage), the transistor Q15 and correspondingly the transistor Q13 turn on.

When the transistor Q13 turns on, the capacitor C12 is discharged through the resistor R28 and the smoke detecting light-emitting element L1 which then emits light, and the transistor Q14 turns on. At the same time, this discharging current causes the capacitor C13 to be charged.

The turning on of the transistor Q15 makes the transistor Q16 of the accumulating circuit 40 turn on, and clock signals are supplied to the flip-flops IC1 and IC2 as light emission synchronizing signals. The time during which the transistor Q13 of the light-emitting section 10 is turned on corresponds to the time during which the capacitor C15 is charged with the base current of the transistor Q15 and due to this charged voltage, the transistor Q15 is turned off. This time is selected, for example, to provide the light emission for 100 $\mu$ seconds at an interval of three seconds.

The transistor Q14 turns on by the discharging current of the capacitor C12 while the transistor Q13 is turned on. The turning off of the transistor Q13 stops the charging operation for the capacitor C13, which then discharges through the resistors of the transistor Q14 connected in parallel therewith. The transistor Q14 is kept turned on by this discharging current.

The transistor Q14 in the turned on state supplies the charges on the capacitor C14, as an operational power, to the operation indicating lamp L2 of the fire signal transmitting section 50 through the resistor R35. The turning-on time of this transistor Q14 is selected such that any person can visually recognize the turning-on of the operation indicating lamp L2, for example 1 ms.

The light-receiving section 20 detects scattered light from the smoke detecting light-emitting element L1 with the smoke detecting light-receiving element PD to amplify the detected signal by the two-stage amplifying circuit, and outputs the amplified signal to the fire discriminating section 30. When the base voltage generated by dividing the output from the light-receiving section 20 by using the resistor R19, reference voltage adjusting variable resistor VR2, and the resistor R18 is lower than the base-emitter voltage of the transistor Q7 of the fire discriminating section 30, it remains turned off to output a high (H) signal to the accumulating circuit 40. On the other hand, when the base voltage exceeds the base-emitter voltage, the transistor Q7 turns on to output a low (L) signal as a fire discriminating signal to the accumulating circuit 40.

The flip-flop IC1 of the accumulating circuit 40 provides an H signal through its output terminal Q1 and an L signal through its inverted output terminal .Q1 so as to reset the flip-flop IC2, when the clock signal (synchronizing signal from the light-emitting section 10) is supplied to its clock terminal CL1 from the transistor Q16 while receiving an H signal at its input terminal D1. As a result, the output terminal Q2 of the flip-flop IC2 provides no output signal, such that the capacitor C17 is recharged through the current limiting resistor R37 up to a predetermined voltage.

When a clock signal is supplied to the clock terminal CL2, the flip-flop IC2 supplies an L output to the fire signal transmitting section 50 through its output terminal Q2 in response to the L output of the inverted output terminal .Q1 of the flip-flop IC1. Accordingly, the silicon control rectifying element Q11 of the transmitting section 50 is kept turned off.

The flip-flop IC1 of the accumulating circuit 40 provides the L output through its output terminal Q1 and the H output through its inverted output terminal .Q1, if the L signal used as the fire discriminating signal is input to the input terminal D1 when the clock signal is input to the clock terminal CL1. On the other hand, the flip-flop IC2 maintains the L output at its output terminal Q2, since the inverted output terminal .Q1 of the flip-flop IC1 is still in an L output state when the clock signal is supplied to the clock terminal CL2.

In this state, if the L signal used as the fire discriminating signal is input again to the input terminal D1 when the clock signal is supplied to the clock terminal CL1 of the flip-flop IC1, the flip-flop IC2 generates the H output through its output terminal Q2 in response to the H output of the inverted output terminal .Q1 of the flip-flop IC1.

The H output of the flip-flop IC2 causes the charge stored in the capacitor C17 to discharge as the output signal, and in response to the output signal of this discharging current, the silicon control rectifying element Q11 of the fire signal transmitting section 50 turns on so as to transmit the fire signal through the terminals 1 and 2 or 3. Accordingly, the operation indicating lamp L2 changes from the intermittent lighting state caused by the pulse outputs to a continuous lighting state caused by the fire signals.

During the transmission of the fire signals, if the power source voltage supplied from e.g. the receiver fluctuates as to increase and the current flowing through the series circuit composed of the resistor R25 and the operation indicating lamp L2 increases such that the voltage drop of this series circuit exceeds the Zener voltage of the Zener diode Z2, the Zener diode Z2 conducts and the transistor Q12 turns on. In consequence, it is possible to prevent the current flowing through the operation indicating lamp L2 from unnecessarily increasing due to the fluctuation of the power source voltage.

When the clock signal is sent to the clock terminal CL1 of the flip-flop IC1 of the accumulating circuit 40, if the level of the input terminal D1 has already been changed from the L signal to the H signal i.e. the fire discriminating section 30 does not provide any discriminating output, the output terminal Q1 of the flip-flop IC1 changes from an L output state to the H output state while the inverted output terminal .Q1 changes from the H output state to the L output state. Accordingly, the flip-flop IC2 is reset and the output terminal Q2 maintains the L output state. As a result, even if any temporary phenomenon makes the fire discriminating section 30 output the discriminating signal only one time, the accumulating circuit 40 does not provide any output and the transmitting section 50 does not provide any fire signal.

When the power supply from the receiver etc. is temporarily shut down for resetting the operated fire detector, the silicon control rectifying element Q11 recovers and the flip-flops IC1 and IC2 are set to the initial state.

In testing the fire detector for judging whether or not it is operable, a test signal is input to the terminal 4 from a not shown receiver or the like to turn on the transistor Q5 of the testing circuit 80, or a not shown magnet is disposed adjacent to the detector to turn the red switch RS on. As a result, the the resistor R11 of the testing circuit 80 is connected in parallel to the resistor R10 of the second-stage amplifying circuit of the light-receiving section 20 so that the gain of the second amplifying circuit increases. Then, the amplified output from the light-receiving element PD due to the light emission of the light-emitting element L1 in the no smoke state case would become the output required to operate the transistor Q7 of the fire discriminating section 30.

If there are no abnormalities in the light-emitting element L1 of the light-emitting section 10, the light-receiving element PD of the light-receiving section 20, and the amplifying circuit, then the fire discriminating section 30 generates the fire discriminating output. When the plurality of fire discriminating outputs are continuously generated, the accumulating circuit 40 and the fire signal transmitting circuit 50 are activated to transmit fire signals and to change the operation indicating lamp L2 to the continuous lighting state. On the contrary, if there is any abnormality in such components and circuits, the transmitting circuit 50 does not transmit any fire signal and the operation indicating lamp L2 does not continuously light.

For adjusting the sensitivity of the photoelectric type smoke detector, a tester such as a voltmeter is first connected between the terminals 5 and 6, and subsequently the output adjusting variable resistor VR1 of the light-receiving section 20 is adjusted such that the amplified output of the section 20 in the state without smoke in the dark box becomes a predetermined value. The amplified output of the light-receiving section 20 at this time is equal to the output provided by receiving the light which is emitted from the light-emitting element L1 and then scattered on the inner wall of the dark box.

Next, the reference voltage adjusting variable resistor VR2 of the fire discriminating section 30 is adjusted such that the transistor Q7 turns on when smoke of a predetermined density e.g. a density of 10%/m or a reflection plate generating light reflection equivalent thereto is disposed in the dark box. At this time, the smoke density or the reflection plate to be disposed in the dark box need not be a smoke density judged as a fire or a reflection plate equivalent thereto. Namely, each detector can adjust the amplified output from the amplifying circuit to a predetermined value by adjusting the variable resistor VR1. Accordingly, the differences in the amplified outputs among the detectors due to the dispersions of characteristic values of the circuit components such as the light-emitting elements L1, light-receiving elements PD and the amplifying circuits are corrected.

The amplified output is proportional to the smoke density entering between the light-emitting element L1 and the light-receiving element PD. Therefore, when a desired smoke density or a reflection plate generating a reflection light equivalent thereto is used, a voltage drop corresponding to the desired smoke density must be generated in the resistor R18 of the fire discriminating section 30.

Accordingly, for adjusting the discriminating level by the reference voltage adjusting variable resistor VR2, the smoke density in the dark box or the reflection amount from the reflection plate equivalent thereto may be sufficient with a desired smoke density or a reflection amount corresponding to the desired smoke density, and reference voltage adjusting variable resistor VR2 is adjusted such that a voltage drop generated in the series resistance circuit composed of the variable resistor VR2, the resistors R18 and R19 becomes the voltage drop corresponding to the desired smoke density. As a result, when smoke of a predetermined density discriminated as a fire flows into the dark box, due to the amplified output at this time, a voltage drop necessary to turn on the transistor Q7 is generated in the resistor R18 of the fire discriminating section 30.

The output i.e. the light-emitting amount of the light-emitting element L1 of the light-receiving section 10 reduces as the temperature increases while the base-emitter voltage $V_{BE}$ of the transistor Q6 of the sensor output circuit 70 reduces as the temperature increases. Therefore, this transistor Q6 acts to compensate for the output reduction of the light-emitting element L1. Further, the transistor Q6 functions to expand the sensor output by using its base-emitter voltage $V_{BE}$ and then outputs it to the output terminals 5 and 6. As a result, since any slight variation of the sensor output is expanded and output between the output terminals 5 and 6, it becomes possible to readily perform the sensitivity adjustment by adjusting the output adjusting variable resistor VR1 or the reference voltage adjusting variable resistor VR2 and by the checking of the sensitivity variation.

The constant voltage circuit 60 keeps the current flowing through the Zener diode Z1 constant by the constant current effect of the constant current circuit 62 composed of the FET Q10 and the resistor R22, to keep the current consumption in the constant voltage circuit 60 constant. Therefore, any fluctuation of the power source voltage from the receiver et al. does not affect the current consumption of the constant voltage circuit 60.

A series circuit composed of the current limiting resistor R37 and the capacitor C17 is provided in the accumulating circuit 40 for preventing the fire signal transmitting circuit 50 from activating by the mis-operation of the flip-flops IC1 and IC2 at the time the power source is turned on. The capacitor C17 acts to supply power to the flip-flops IC1 and IC2 to limit the currents to be supplied to the flip-flops IC1 and IC2 by the current limiting resistor R37 until the charging voltage reaches a predetermined value.

Consequently, even if the states of the flip-flops IC1 and IC2 are unstable immediately after turning on the power source and the flip-flop IC2 generates the H output at its output terminal Q2, the flip-flop IC2 acts not to provide the current required to trigger the silicon control rectifying element Q11.

When clock pulses (synchronizing signals) are supplied from the light-emitting section 10 and the output terminal Q2 of the flip-flop IC2 is set to an L output state, the capacitor C17 is charged up, thereby preventing any mis-operation on turning on the power source.

With the aforementioned composition of the detector according to the first embodiment of the present invention, the following notable advantages can be obtained:

(1) The first-stage amplifying circuit having the output adjusting variable resistor VR1 for amplifying the output of the light-receiving element PD is provided, and a fire discriminating section 30 having a reference voltage adjusting variable resistor VR2 to which the amplified output from the light-receiving section 20 is supplied is also provided. As a result, it is possible to adjust the amplified output to a predetermined value by the output adjusting variable resistor VR1, and to adjust the switching level of the fire discriminating section 30 to a predetermined value by the reference voltage adjusting variable resistor VR2.

Therefore, the sensitivity of the photoelectric smoke detector can be readily adjusted since the amplified output from the amplifying circuit can be the same value for the photoelectric smoke detectors while the switching level of the fire discriminating section can be the same value for the photoelectric smoke detectors.

Further, since the amplified outputs of the amplifying circuits have the same value for the photoelectric smoke detectors, it is possible to easily recognize the degree of fluctuation of the detected outputs in the no smoke state from the initially detected output.

(2) The accumulating circuit 40 discriminates whether the transistor Q7 of the fire discriminating section 30 has been turned on for a plurality of times successively in synchronism with the pulse outputs from the light-emitting section 10, and dispatches the detected output to the fire signal transmitting section 50 when the discriminated result is affirmative. As a result, the fire signal transmitting section 50 does not erroneously operate on turning on the power source.

(3) The constant voltage circuit 60 includes a transistor Q9 having the constant current circuit 62 between its collector and base, and the Zener diode Z1 connected between the base of the transistor Q9 and earth. Therefore, the current flowing through the Zener diode Z1 is always constant by virtue of the constant current circuit 62 connected in series with the diode Z1, even if the power source voltage applied between the collector of the transistor Q9 and the cathode of the Zener diode Z1 by the fire receiver is varied. As a result, irrespective of the value of the power source voltage, the current consumption of the constant voltage circuit 60 becomes constant.

(4) The light-emitting section 10 includes the pulse width expanding circuit 12 for expanding the pulse width of the pulse output from the oscillating circuit. Since the output of the pulse width expanding circuit 12 is connected to the operation indicating lamp L2 of the fire signal transmitting section 50, the pulse output of the oscillating circuit for controlling the light emission of the light-emitting element L1 is expanded by the pulse width expanding circuit 12, and the operation indicating lamp 12 turns on by the expanded pulse. As a result, it is possible to recognize any abnormality in the detector by the extinguishing of the operation indicating lamp when the oscillation of the oscillating circuit stops.

Second Embodiment

Figure 2:
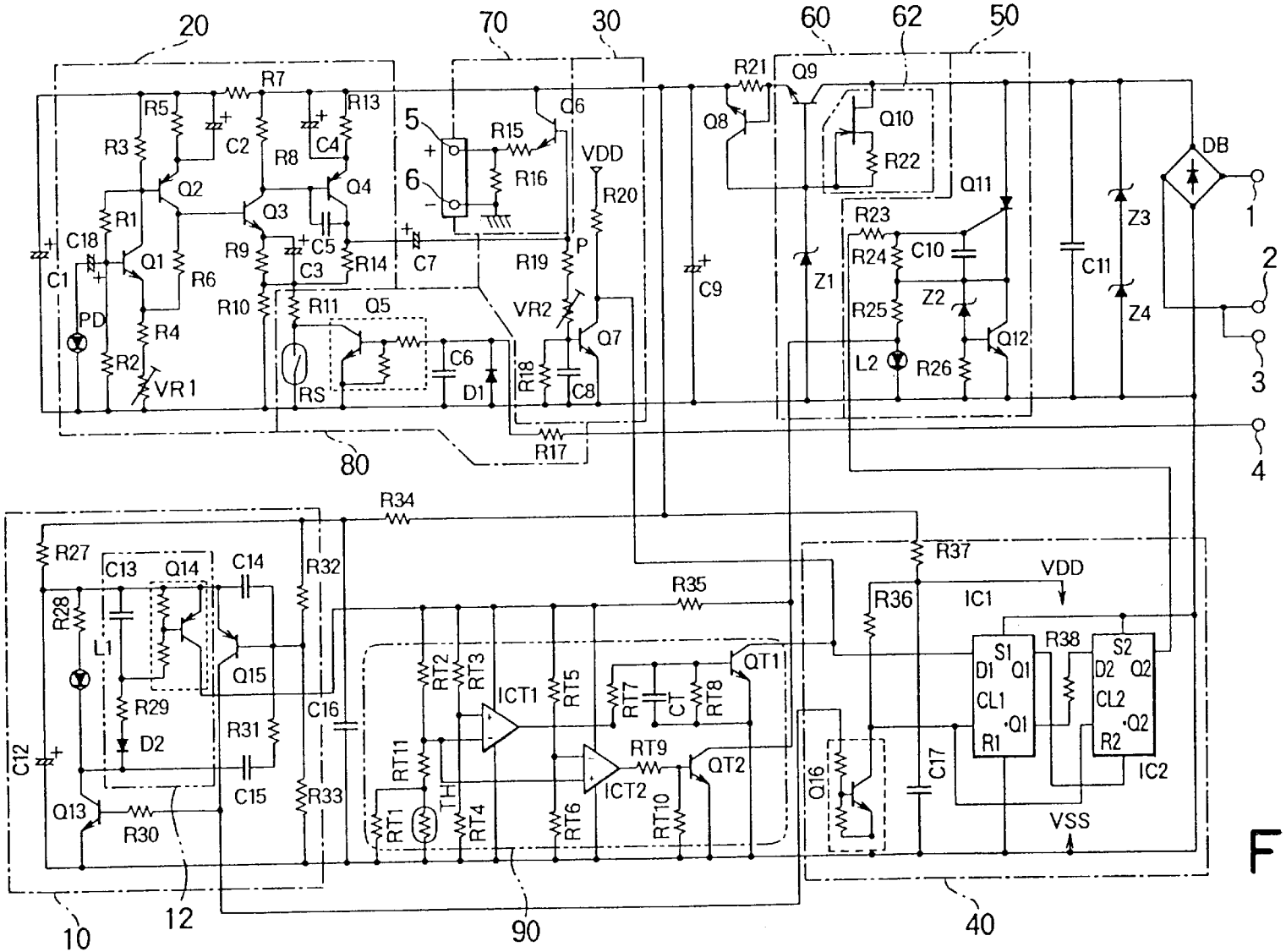
FIG. 2 is a circuit diagram showing a heat-photoelectric type fire detector according to a second embodiment of the present invention.

FIG. 2 is a circuit diagram of a heat-photoelectric type fire detector according to a second embodiment of the present invention. This embodiment is composed by newly adding a heat detecting section 90 to the detector of the first embodiment shown in FIG. 1. The heat detecting section 90 is connected to the light-emitting section 10, the accumulating circuit 40 and the fire signal transmitting section 50 for discriminating the fire by detecting the generation of heat and transmits a fire discriminating signal to the accumulating circuit 40.

The heat detecting section 90 includes a heat-sensitive element TH, comparators ICT1 and ICT2 respectively composed of operational amplifiers, transistors QT1 and QT2, a capacitor CT and resistors RT1–RT11. As the heat-sensitive element TH, a negative characteristic thermistor or the like is used for generating an output corresponding to the physical amount of the detected heat.

Next, the operation of the fire detector according to this second embodiment will be described. The heat detecting section 90 receives, as power, pulse signals having been expanded in the pulse width expanding circuit 12 of the light-emitting section 10. Then the heat detecting section 90 intermittently detects any resistance change of the heat-sensitive element TH due to the temperature change, which is monitored by the comparators ICT1 and ICT2. The comparator ICT1 is used for discriminating the fire, and provides an H output when the input voltage of its negative-side terminal becomes lower than the fire discriminating reference voltage of the positive-side terminal i.e. the divisional voltage of the resistors RT3 and RT4 due to the resistance drop by the heat of the heat-sensitive element TH. In response to this H output, the transistor QT1 turns on and the fire discriminating signal of L output is supplied to the flip-flop IC1 an the accumulating circuit 40.

Although the input terminal D1 of the flip-flop IC1 of the accumulating circuit 40 receives the output from the fire discriminating section 30 and the output from the transistor QT1 of the heat detecting section 90, the accumulating circuit 40 operating totally in the same manner as in the first embodiment. Namely, when the fire discriminating section 50 discriminates any fire by smoke, or the heat detecting section 90 discriminates any fire by heat so as to provide the fire discriminating signal of an L output successively two times to the input terminal D1 of the flip-flop IC1, the H output is supplied to the fire signal transmitting section 50 from the accumulating circuit 40. Accordingly, fire signals are transmitted to a fire receiver not shown etc. from the fire signal transmitting section 50 and the operation indicating lamp L2 changes from the intermittent lighting state to the continuous lighting state.

Further, in case of the heat-sensitive element TH being snapped, when the power is supplied to the heat detecting section 90 from the pulse width expanding circuit 12, the potential at the connecting point of the resistors RT2 and RT11 exceeds the reference voltage for discriminating snapping by the divisional resistors RT5 and RT6. As a result, the H output is provided from the comparator ICT2 to turn on the transistor QT2. Therefore, the operation indicating lamp L2 of the fire signal transmitting section 50 is short-circuited. In consequence, the operation indicating lamp L2 stops the intermittent lighting by the pulse signals supplied from the pulse width expanding circuit 12 of the light-emitting section 10 to indicate the occurence of abnormalities. The operation indicating lamp L2 also stops lighting when neither the smoke detection nor the heat detection can be carried out by the stopping of the oscillation of the oscillating circuit of the light-emitting section 10, from which one can recognize the occurence of abnormalities in the detector.

The other functions are the same as in the first embodiment.

In this second embodiment, the output from the oscillating circuit in the light-emitting section 10 having been expanded to be a pulse signal having a width of approximately 1 ms in the pulse width expanding circuit 12 is supplied to the heat detecting section 90 as the operational power. Alternatively, it is also possible, when it is unnecessary to intermittently light the operation indicating lamp L2, to supply the pulse signal having a width of approximately 100 $\mu$s output from the oscillating circuit in the light-emitting section 10 directly to the heat detecting section 90.

As mentioned above, according to the second embodiment of this invention, since the pulse signals from the oscillating circuit of the light-emitting section 10 are shunted and supplied to the heat detecting section 90 for use as the power source, the heat is intermittently detected. Accordingly, the power consumption by the heat detecting section 90 is reduced, and an oscillating circuit for detecting heat need not be provided separately.

Third Embodiment

Figure 3:
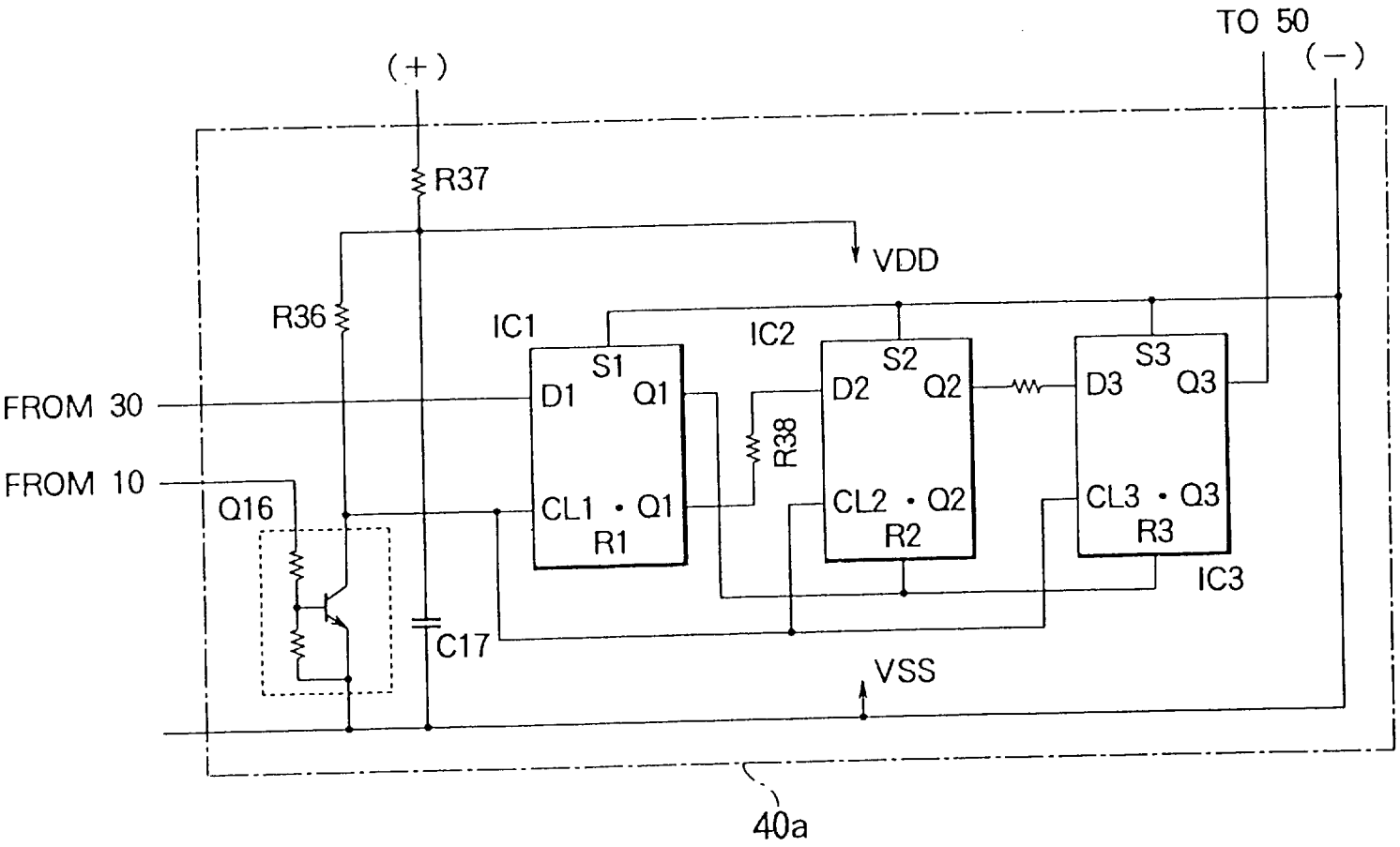
FIG. 3 is a circuit diagram showing an accumulating circuit according to a third embodiment of the present invention.

The accumulating circuit 40 used in the previous embodiments 1 and 2 is a two-stage type accumulating circuit composed of two serially connected D-type flip-flops IC1 and IC2 which provided the output signal to the fire signal transmitting section 50 when the fire discriminating outputs are provided successively two times from the fire discriminating section 30 or the fire discriminating section 30 and the heat detecting section 90. Alternatively, however, it is also possible to use a three-stage type accumulating circuit 40*a* composed of three D-type flip-flops IC1 and IC2 and IC3 coupled as shown in FIG. 3. In this case, the output from the accumulating circuit 40*a* is supplied to the fire signal transmitting section 50 when the fire discriminating section 30 generates the fire discriminating output successively three times.

Fourth Embodiment

Figure 4:
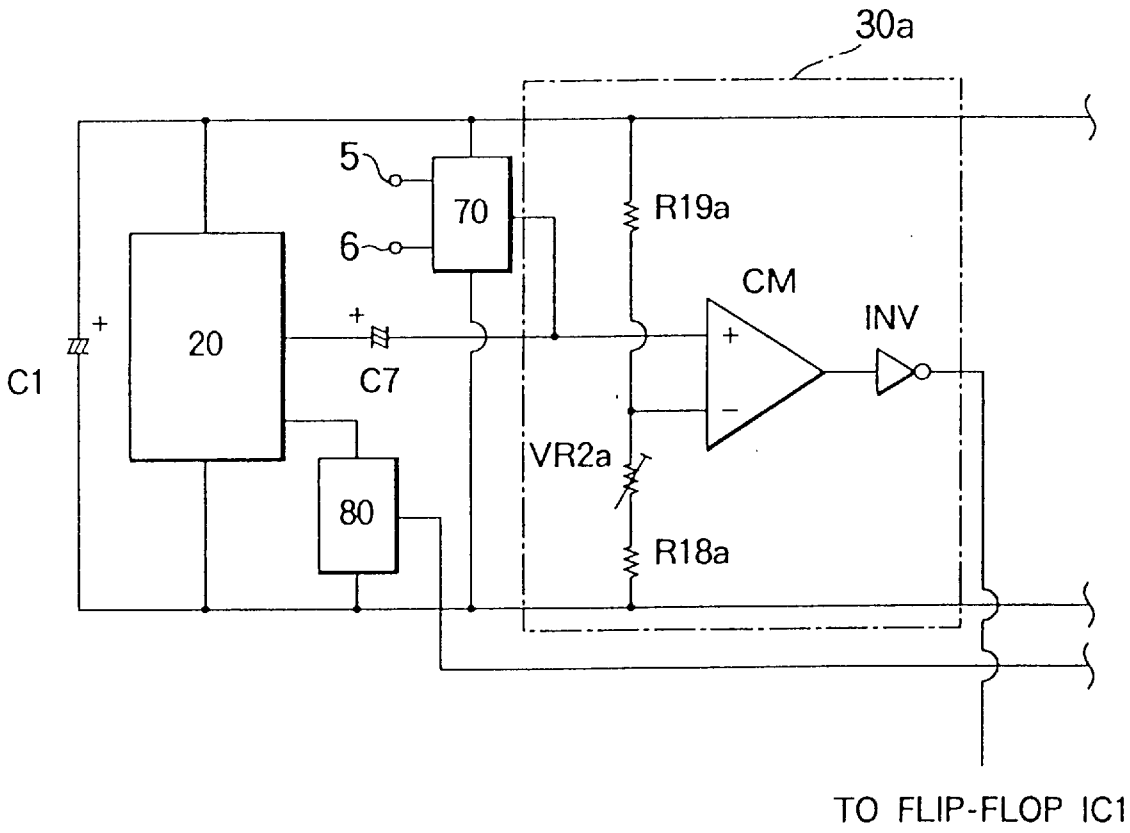
FIG. 4 is a circuit diagram showing a fourth embodiment of the present invention.

In the first and the second embodiments, the fire discriminating section 30 has performed the fire discrimination by the transistor Q7. Alternatively, however, it is also possible to use a fire discriminating section 30*a* for performing the fire discriminating operation by a comparator CM as shown in FIG. 4. An input terminal of the comparator CM receives the output from the light-receiving section 20, and the other input terminal is connected to the reference voltage output point of the reference voltage generating circuit composed of the fixed resistors R18*a* and R19*a* and the variable resistor VR2*a*. An output terminal of the comparator CM is connected to the input terminal D1 of the flip-flop IC1 in the accumulating circuit 40 via an inverter circuit INV. When the output from the light-receiving section 20 is below a reference voltage determined by the fixed resistors R18*a* and R19*a* and the variable resistor VR2*a*, the comparator CM acts to generate a low output. As a result, a high output is applied to the accumulating circuit 40 through the inverter circuit INV. On the other hand, when the output from the light-receiving section 20 is equal to or above the reference voltage, the comparator CM acts to generate a high output, and a low output is applied to the accumulating circuit 40 through the inverter circuit INV.

Fifth Embodiment

In the fire detectors described in the aforementioned embodiments, the fire discrimination is carried out on the basis of the smoke density detected by the light-receiving section 20 or the temperature detected by the heat detecting section 90 and the fire signal is transmitted when any fire is recognized. This invention can be applied to analog-type fire detector which directly transmits signals corresponding to the physical amount of the fire phenomenon such as the density of detected smoke and temperature.

Figure 5:
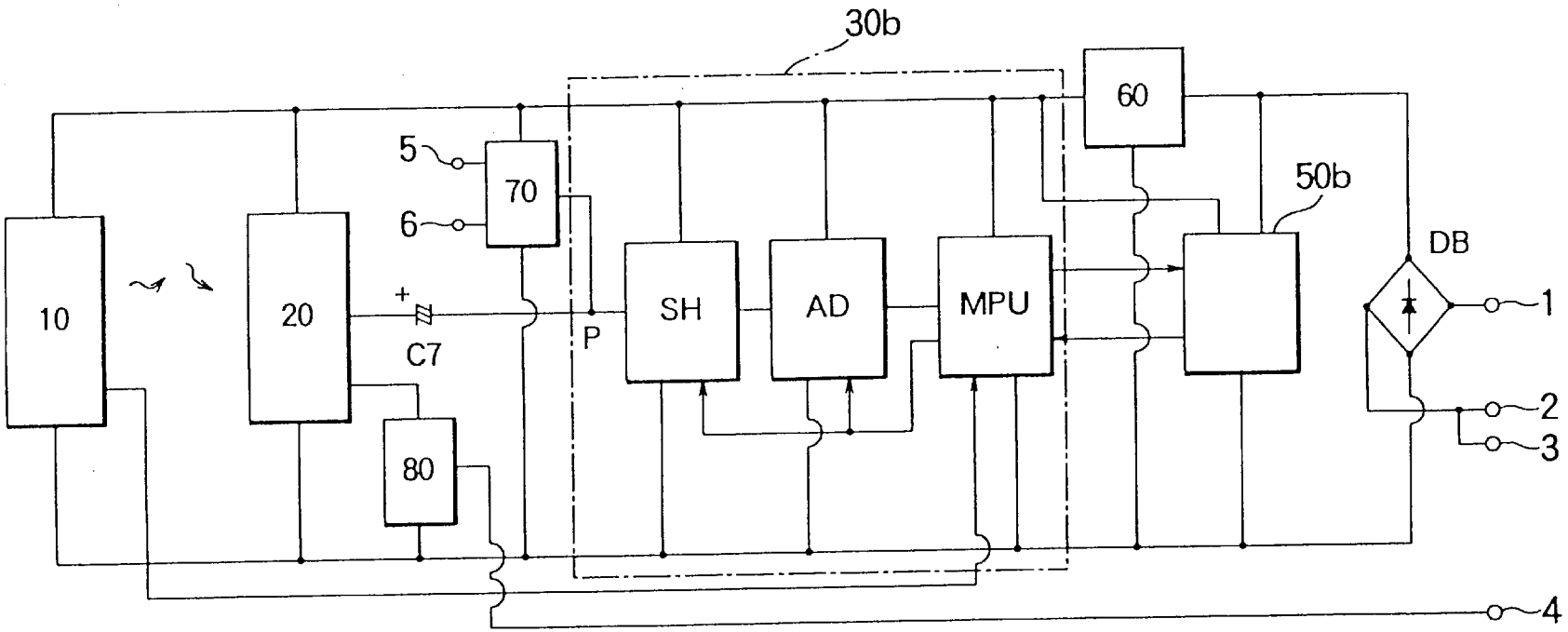
FIG. 5 is a circuit diagram showing a fifth embodiment of the present invention.

FIG. 5 shows an analog-type photoelectric fire detector according to the present invention. This detector uses a signal processing circuit 30*b* instead of the fire discriminating section 30, and a signal transmitting/receiving section 50*b* instead of the fire signal transmitting section 50 in the detector of the first embodiment shown in FIG. 1. The signal processing section 30*b* includes a sample and hold circuit SH connected to the output of the light-receiving section 20, an A/D converter AD connected to the sample and hold circuit SH, and a microcomputer MPU connected to the sample and hold circuit SH and the A/D converter AD. The signal transmitting/receiving section 50*b* includes a parallel/serial converter composed of, for example, a shift register, a transmitting circuit having a switching element such as a transistor which is turned on and off by a serial code signal output from the parallel/serial converter, a receiving circuit having a resistor for receiving signals, and a serial/parallel converter for converting the output from the receiving circuit to a parallel code.

The microcomputer MPU outputs a holding command to the sample and hold circuit SH in response to the receipt of the synchronizing signal from the light-emitting section 10. The amplified output from the light-receiving section 20 is held by the sample and hold circuit SH. Then, the microcomputer MPU outputs a converting command to the A/D converter AD to read the degital signal which has been held by the sample and hold circuit SH and converted by the A/D converter AD. When a polling signal is received from an unillustrated fire receiver through the signal transmitting/receiving section 50*b*, the microcomputer MPU transmits the degital signal indicating the analog amount to the fire receiver through the signal transmitting/receiving section 50*b*.

It is also possible to build an analog-type heat-photoelectric fire detector corresponding to the second embodiment in FIG. 2.

What is claimed is:

1. A heat-photoelectric type fire detector comprising:

a light-emitting section for emitting a pulsed light for detecting smoke;

a light-receiving section, having a first variable resistor for adjusting an output, for receiving a scattering light of the light emitted from said light-emitting section caused by the smoke;

a smoke fire discriminating section, having a second variable resistor for adjusting a reference voltage, for generating a smoke fire discriminating output when the output from said light-receiving section reaches the reference voltage;

a heat-sensitive element for detecting heat;

a heat fire discriminating section for outputting a heat fire discriminating output when a detected output from said heat-sensitive element reaches a predetermined level; and a fire signal transmitting section, having an operation indicating lamp, for outputting a fire signal when a smoke fire discriminating output or a heat fire discriminating output is generated from at least one of said smoke fire discriminating section and said heat fire discriminating section;

wherein said light-emitting section comprises a light-emitting element for detecting smoke, an oscillating circuit for making said light-emitting section emit light by supplying a pulsed output thereto and supplying the pulsed output as a monitoring power source to said heat fire discriminating section, and a pulse width expanding circuit for expanding a pulse width of the pulsed output from said oscillating circuit and supplying it to said operation indicating lamp.

2. A detector according to claim 1, wherein said heat fire discriminating section comprises:

a fire discriminating circuit for discriminating whether the detected output from said heat-sensitive element has reached the predetermined level;

a discriminating output circuit for supplying the heat fire discriminating output to said fire signal transmitting section on the basis of an output from said fire discriminating circuit;

a wire-snap detecting circuit for detecting any wire-snap in said heat-sensitive element; and a wire snap indication circuit for indicating a presence of snap on the operation indicating lamp of said fire signal transmitting section when said wire-snap detecting circuit detects any wire-snap of said heat-sensitive element.

3. A detector according to claim 2, wherein said fire discriminating circuit further comprises a first comparator for comparing the detected output from said heat-sensitive element with a first reference voltage.

4. A detector according to claim 2, wherein said wire-snap detecting circuit further comprises a second comparator for comparing the detected output from said heat-sensitive element with a second reference voltage.

5. A detector according to claim 2, wherein said wire-snap indication circuit includes a first transistor, which short-circuits both ends of said operation indicating lamp when said wire-snap detecting circuit detects any wire-snap in said heat-sensitive element.

6. A detector according to claim 1, wherein said heat-sensitive element is a thermistor.

7. A heat-photoelectric type fire detector comprising:

a light-emitting section for emitting pulsed light for detecting smoke;

a light-receiving section for receiving scattered light of the light emitted from said light-emitting section caused by smoke;

a smoke fire discriminating section for providing a smoke fire discriminating output when a light-receiving output from said light-receiving section reaches a reference voltage;

a heat-sensitive element for detecting heat;

a heat fire discriminating section for providing a heat fire discriminating output when a detected output from said heat-sensitive element reaches a predetermined level;

a fire signal transmitting section for transmitting a fire signal when a smoke fire discriminating output or a heat fire discriminating output is output from at least one of said smoke fire discriminating section and said heat fire discriminating section; and a constant voltage circuit for converting an externally supplied power source voltage into a predetermined voltage, and supplying it to said light-emitting section, said light-receiving section, said smoke fire discriminating section and said heat fire discriminating section;

said constant voltage circuit comprising:

a first transistor having an emitter connected to said light-emitting section, said light-receiving section, said smoke fire discriminating section and said heat fire discriminating section;

a first Zener diode having an end connected to a base of said first transistor; and a constant current circuit connected between a collector and the base of said first transistor.

8. A detector according to claim 7, wherein said constant current circuit further comprises:

a junction-type FET having a drain and a gate respectively connected to the collector and the base of said first transistor; and a first fixed resistor connected between a source and the gate of said junction-type FET.

9. A detector according to claim 7, wherein said detector further comprises:

an accumulating circuit for discriminating whether a smoke fire discriminating output or a heat fire discriminating output has been provided from at least one of said smoke fire discriminating section and said heat fire discriminating section in synchronicity with the pulse light from said light-emitting section, and supplying a detected output to said fire signal transmitting section when discriminating that the smoke fire discriminating output or the heat fire discriminating output have been provided for a plurality of predetermined times successively; and wherein said fire signal transmitting section transmits the fire signal upon receiving the detected output from said accumulating circuit.

10. A detector according to claim 9, wherein said fire signal transmitting section further comprises:

a switching element turning on in response to the detected output from said accumulating circuit; and an operation indicating lamp connected in series with said switching element.

11. A detector according to claim 10, wherein said light-emitting section further comprises:

a light-emitting element for detecting smoke;

an oscillating circuit for making said light-emitting element emit light by supplying the pulsed output thereto; and a pulse width expanding circuit for expanding a pulse width of the pulsed output from said oscillating circuit and outputting it to said operation indicating lamp of said fire signal transmitting section.

* * * * *